United States Patent [19]

Augros

[11] Patent Number: 4,512,487

[45] Date of Patent: Apr. 23, 1985

[54] BOTTLE STOPPER

[75] Inventor: Jacques Augros, Villiers le Bel, France

[73] Assignee: Arts Et Techniques Nouvelles, Paris, France

[21] Appl. No.: 641,434

[22] Filed: Aug. 16, 1984

Related U.S. Application Data

[63] Continuation of Ser. No. 440,178, Nov. 8, 1982, abandoned.

[30] Foreign Application Priority Data

Nov. 10, 1981 [FR] France ..... 81 21099

[51] Int. Cl.[3] ..... B65D 41/18

[52] U.S. Cl. ..... 215/274

[58] Field of Search ..... 215/274, 273, 307

[56] References Cited

U.S. PATENT DOCUMENTS

| | | | |
|---|---|---|---|
| 2,601,040 | 6/1952 | Livingstone | 220/DIG. 5 |
| 3,397,803 | 8/1968 | Melton | 215/274 X |

FOREIGN PATENT DOCUMENTS

| | | | |
|---|---|---|---|
| 661591 | 7/1965 | Belgium . | |
| 1427723 | 1/1966 | France . | |
| 1475336 | 2/1967 | France . | |
| 2259761 | 8/1975 | France . | |
| 2309425 | 11/1976 | France . | |
| 552309 | 12/1956 | Italy | 215/274 |
| 354683 | 7/1961 | Switzerland | 215/307 |

*Primary Examiner*—Donald F. Norton
*Attorney, Agent, or Firm*—Louis E. Marn

[57] ABSTRACT

The stopper device according to the invention for bottles with a neck, comprises a neck adapter, and a stopper designed to be inserted in the stopping sleeve of the neck adapter.

According to the invention, the neck adapter is made up of two separate parts, namely a sleeve-holding plate constituted by the stopping sleeve encircled at its upper part by an external peripheral flange designed to rest in tight manner on the upper rim of the bottle neck, and a cap formed by the external skirt provided for fastening the adapter to the bottle neck, and comprising an inner peripheral rim, which covers up at least part of the external flange of the sleeve-holding plate.

12 Claims, 9 Drawing Figures

16
15
18
17
19
1
6
20

BOTTLE STOPPER

This is a continuation of application Ser. No. 440,178, filed Nov. 8, 1982, now abandoned.

The present invention relates to a stopper device for bottles with necks, of the type comprising, on the one hand, a neck adapter with an external skirt to fasten it to the neck of the bottle and an internal stopping sleeve, and on the other hand, a stopper designed to be inserted into the stopping sleeve of the neck adapter.

Such a device is described in French Utility Certificate No. 2 259 761 filed by the Applicant, which device has proved very useful in that it has procured an easy way to stopper all types of bottles regardless of the size of the necks. In said device, the neck adapter is a monoblock piece in plastic material and tightness between the bottle and the adapter is obtained by force-fitting a ring under the profile of the bottle neck.

Because of this, the adapter has to withstand strong stresses, and in particular tensions which are accentuated by the contact with the products or vapors contained inside the bottle which can cause stress-cracking of the material.

It is the object of the present invention to propose a perfectly reliable stopping device in which the neck adapter does not risk to become worn out.

This object is reached according to the invention due to the fact that the neck adapter is made up of two separate parts, namely a sleeve-holding plate constituted by the stopping sleeve encircled at its upper part by an external peripheral flange designed to rest in tight manner on the upper rim of the bottle neck, and a cap formed by the external skirt provided for fastening the adapter to the bottle neck, and comprising an inner peripheral rim, which covers up at least part of the external flange of the sleeve-holding plate, the two parts being joined together so that the adapter can be operated as one piece, whilst being dissociated as far as internal stresses are concerned.

Therefore, the neck adapter according to the invention can, on the outside, be conventional in design and of monoblock aspect: it lends itself to all the conventional operations just like a conventional neck adapter, and in particular it can fit automatically on the bottles.

Nevertheless, according to its original structure, the parts of the adapter required to withstand the strains and those risking to be in contact with the products contained in the bottle, have been dissociated. Such dissociation authorizes the use of different materials to produce each of the two parts, and thus to optimize the mechanical or chemical characteristics specially required for each part: for example for the sleeve-holding plate, the resistance to chemical aggressions, and the flexibility which promotes tightness, and for the cap, the resistance to stresses, thus ensuring for the neck adapter, long life, reliability and permanent tightness.

In addition, the constitution of the neck adapter according to the invention makes it easy to produce by molding.

Advantageously, the upper surface of the flange of the sleeve-holding plate is provided with a peripheral shoulder member which provides a peripheral recess in which the inner rim of the cap can fit exactly, this permitting to force-assemble the cap with the plate, and make them into one piece.

Various means can be used to achieve the mechanical connection of the two parts. For example, they can be joined together by clipping the inner rim into a complementary shoulder member of the flange of the sleeve-holding plate, or by way of a crimping lip provided on the flange of the plate and crimping the inner rim of the cap or else by clipping the flange of the plate into a hollow provided where the skirt of the cap begins, or finally, by fitting-in projections provided on the faces opposite the inner rim of the cap and of the flange.

Advantageously, the connection can be achieved by molding the sleeve-holding plate over the cap, suitable holding projections or members being provided.

The invention will be more readily understood on reading the following description with reference to the accompanying drawings, in which.

Figure 1:
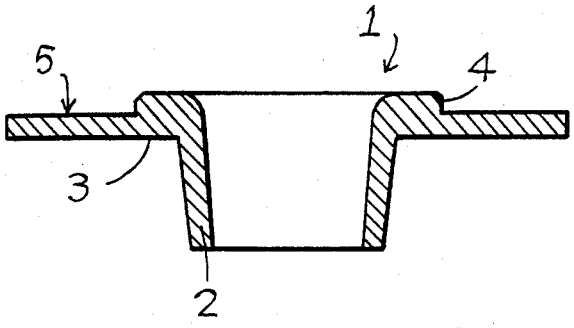
FIG. 1 shows a cross-section of a first embodiment of the sleeve-holding plate.
Figure 2:
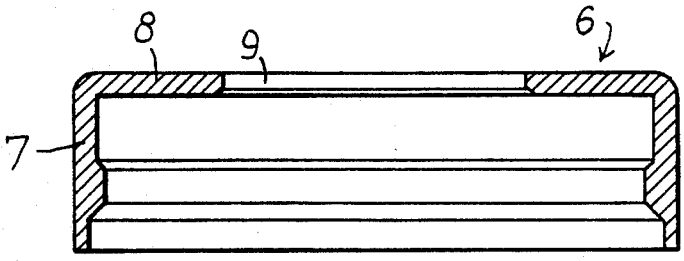
FIG. 2 shows a cross-section of a first embodiment of the cap.

Referring first to FIG. 1, this shows the first part, according to the invention, of the neck adapter, which is the sleeve-holding plate, and which comprises a reversedly funnelled sleeve 2 surrounded at its upper part by a generally circular outer peripheral flange 3. A shoulder member 4 is provided in said flange 3, in such a way as to provide a generally circular peripheral recess 5 for strict insertion of the cap 6 shown in FIG. 2.

By strict insertion is meant that the diameter of the shoulder member 4 and that of the orifice 9 are calculated in such a way that they fit mechanically one into the other (with for example a tolerance of 1/10 mm) to make up a force-assembly, helped by chamfers provided on the edges of the orifice 9 and of the shoulder member 4.

The cap 6 is constituted by a generally cylindrical external skirt 7, provided with an internal peripheral rim 8, which is crown-shaped, and which, due to its dimensions, can be adjusted to the recess 5 of the sleeve-holding plate 1, the effect being to center the central orifice 9 around the shoulder member 4.

Figure 3:
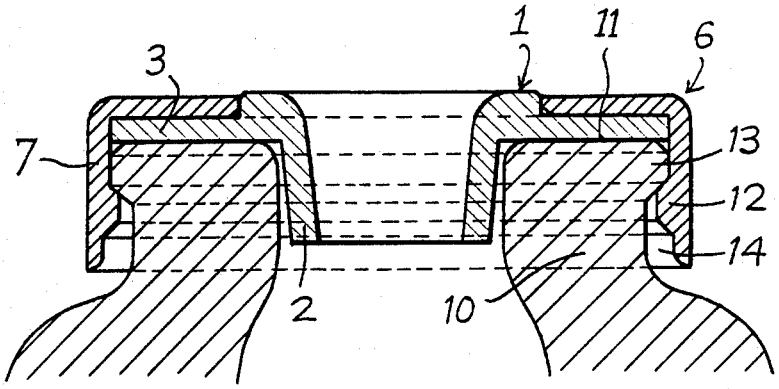
FIG. 3 shows a first embodiment of the neck adapter mounted on the bottle.

FIG. 3 shows how the sleeve-holding plate 1 and the cap 6 are mounted on the neck 10 of a bottle.

The annular flange 3 of said plate 1 comes to rest tightly on a flat portion 11 (or other profile allowing tightness) provided on the upper edge of the neck 10, whereas the stopping sleeve 2 is inserted with play into the neck.

The fastening cap 6 fits over by inserting its inner rim 8 into the recess 5 and is centered first by the cooperation of the inner rim 8 with the shoulder member 4, and second, by the cooperation of the periphery of the flange 3 with the inner surface of the cylindrical skirt 7 of the cap 6.

The cap 6 is secured to the neck by way of a continuous or discontinuous head 12 provided on the inner surface of its skirt 7, the profile and dimensions of which are determined by those of the annular rim 13 of the neck of the bottle.

A clearance 14 is provided on the inside, at the base of the skirt 7, to help centering said skirt and fitting it on the container neck.

Thus according to the invention, only the cap 6 is subjected to relatively strong tensions due to its being force-fitted over the neck of the bottle, but said cap 6 has no contact whatsoever with the noxious products or gases that may be contained in the bottle and can withstand the tensions without problem. It can be produced from a rigid material showing a good resistance to the tensions in question.

Figure 4:
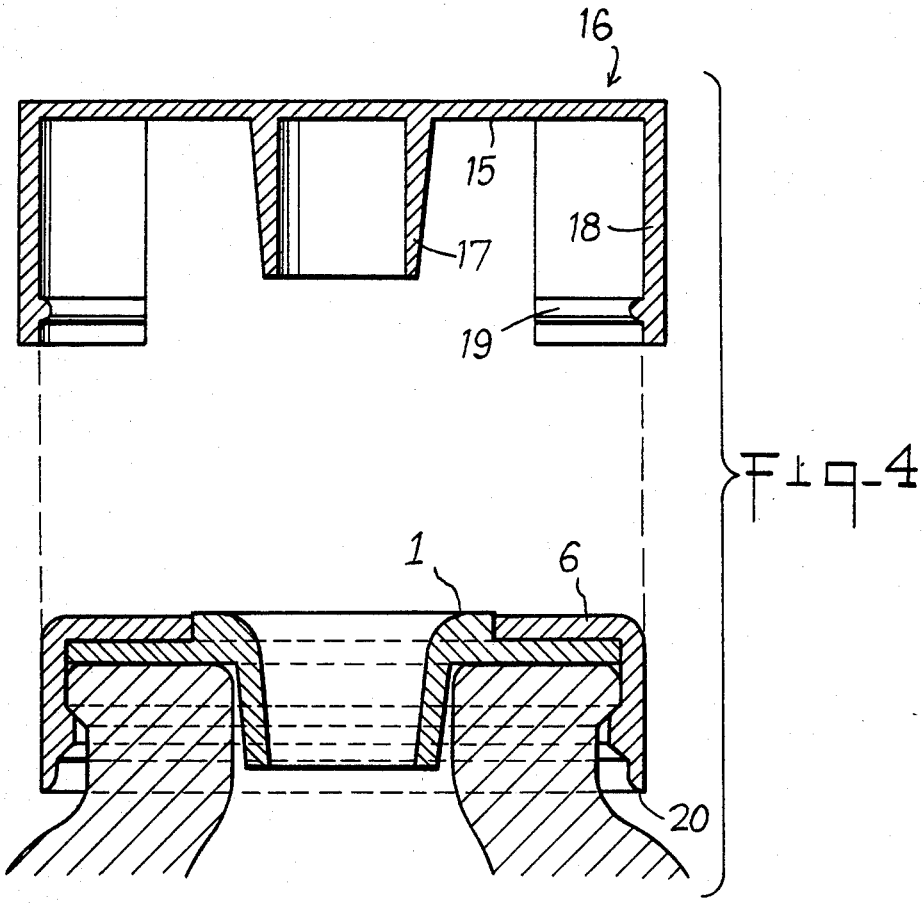
FIG. 4 is a cross-section showing in separated manner the adapter of FIG. 3 and its stopper.

The sleeve-holding plate is not subjected to any tension. Should some stresses happen to be transferred by the cap to the plate, at their joining level, these would be transformed into a radial compression on the central part of the sleeve-holding plate, which would have no effect on the life duration or on the tightness of the plate. The characteristics of the material constituting the plate are essentially the flexibility and the resistance necessary to obtain a good tightness between the flange 3 and the neck 10 of the bottle, on the one hand, and between the sleeve and the stopper on the other hand. Extra tightness may be obtained by making the inner rim 8 of the cap less high than the shoulder member 4, so that said member forms a sealing bead which comes into contact with the upper disc 15 of the stopper 16 (FIG. 4). The sleeve-holding plate can for example be produced in polyethylene, copolymer, butadiene, etc.

The stopper 16 comprises, besides the stopping member 17 proper, cooperating with the sleeve 2, an upper disc 15 which covers the surface of the neck adapter and is provided with two or more side lugs 18 shaped as cylindrical sectors and comprising a holding projection 19 which cooperates with the lower edge 20 of the skirt of the cap 6 to provide a removable hold. The form of the lugs 18 contributes to centering the stopper of the neck of the adapter 1, 6.

Said stopper 16 can be integral with a fancy cover associated to the bottle, or it can constitute a technical part build on to the latter.

The present invention is in no way limited to the description given hereinabove and on the contrary, variants can be brought thereto without departing from its scope.

For example, the sleeve-holding plate 1 can comprise devices to increase its tightness, such as rings, a cylindrical extension of the cone, double walls, etc. and its inviolability can be further increased by sealing the orifice going through the sleeve. Projections or bosses can also be provided for centering and fixing the cover.

The cap can also comprise other sealing rings or marking or fixing devices such as flat portions, grooves.

The cap can also constitute a decorative part by its colors, its shape or by subsequent treatments such as metallizing printing, marking, etc.

Concerning the connection between the sleeve-holding plate and the cap, other embodiments are shown in FIGS. 5 to 9.

Figure 5:
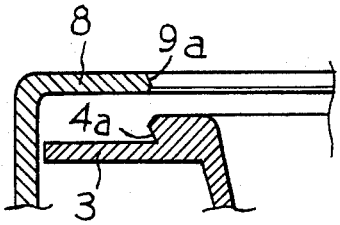
FIG. 5 is a partial cross-section showing in separated manner a second embodiment of the neck adapter.

In FIG. 5, the cap and the plate can clip together due to the fact that the rim 8 has a tapered edge 9*a* which can fit in a reversedly tapered shoulder 9*a* provided on the flange of the plate.

Figure 6:
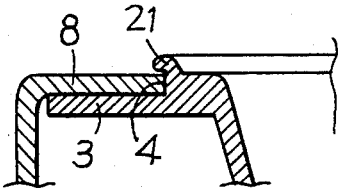
FIG. 6 is a partial cross-section showing a third embodiment of the neck adapter.

In FIG. 6, the height of the shoulder member 4 is greater than the thickness of the rim 8, and the said rim is crimped in by forming a lip 21 with a direct heat or ultrasonic waves.

Figure 7:
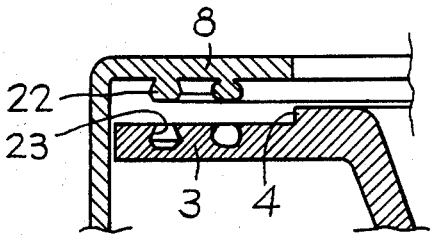
FIG. 7 is a partial cross-section showing in separated manner a fourth embodiment of the neck adapter.

In FIG. 7, male 22 and female 23 fastening devices are provided on the contacting surfaces of the rim 8 and of the flange 3.

Figure 8:
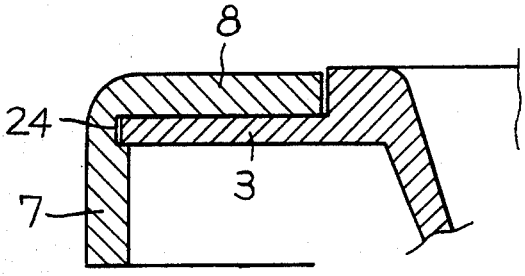
FIG. 8 is a partial cross-section showing a fifth embodiment of the neck adapter.

In FIG. 8, the diameter of the flange 3 of the sleeve-holding plate is designed to be greater than the inner diameter of the cap and insert itself in the recess 24 situated where the skirt 7 of the cap starts. The relative flexibility of the sleeve-holding plate makes the clipping-in operation easy.

Figure 9:
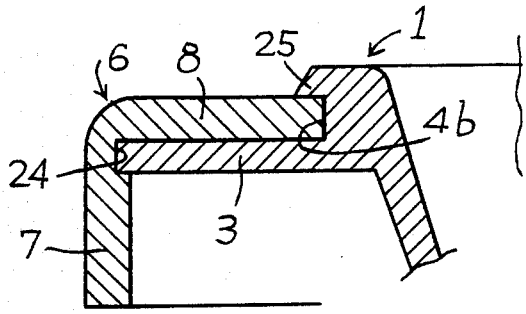
FIG. 9 is a partial cross-section showing a sixth embodiment of the neck adapter.

FIG. 9 illustrates a mixed solution wherein the flange 3 is closely inserted in the recess 24 of the cap whereas the rim 8 of said cap is also inserted in a recess of the plate formed by the shoulder member 4*b* and the upper lip 25. The advantage of this particular embodiment is that it can be produced by moulding the plate 1 directly on the cap 6.

Prefered materials to produce the cap 6 are polypropylene, polyethylene of low density, polyamide, polyester, polycarbonate, ABS polymer, cellulose acetate.

What is claimed is:

1. A neck adapter for a bottle with a neck formed with a pouring rim, which comprises:

a sleeve-holding plate having a downwardly depending internal stopper-receiving sleeve defining an internal opened channel providing means for receiving a stopper and encircled at an upper part by an external peripheral flange, said sleeve having an open top and open bottom to provide a through passageway, said sleeve-holding plate being formed of a flexible material, said sleeve-holding plate designed to rest in a tight manner on said pouring rim of said bottle, and a cap formed with an external skirt provided for fastening said sleeve-holding plate and said cap to said bottle, said cap comprising an inner peripheral rim defining a central orifice which covers at least a part of said external peripheral flange of said sleeve-holding plate, said cap being formed of a relative rigid material, said sleeve-holding plate and said cap joined together to operate as an integrated stopper device for receiving a stopper in said internal opened channel of said stopper-receiving sleeve of said sleeve holding plate.

2. The neck adapter as claimed in claim 1, wherein an upper surface of said external peripheral flange of said sleeve-holding plate is provided with a peripheral shoulder member around which an inner rim of said cap is disposed to permit force-assembly of said cap to said plate.

3. Device as claimed in claim 2, wherein the thickness of the inner rim of the cap is slightly less than the height of the flange of the sleeve-holding plate.

4. Device as claimed in claim 1, wherein the plate and the cap are joined together by clipping the inner rim in a complementary shoulder of the flange of the sleeve-holding plate.

5. Device as claimed in claim 1, wherein the plate and the cap are joined together by way of a crimping lip provided on the flange of the plate and crimping over the inner rim of said cap.

6. Device as claimed in claim 1, wherein the plate and the cap are joined together by way of fitting-in projections provided on the faces opposite the inner rim of the cap and of the flange.

7. Device as claimed in claim 1, wherein the plate and the cap are joined together by clipping the flange of the plate into a recess provided where the skirt of the cap begins.

8. Device as claimed in claim 1, wherein the plate and the cap are joined together by molding the sleeve-holding plate on to the cap.

9. Device as claimed in claim 1, wherein the skirt comprises at least a lower fastening bead which cooperates with an external annular boss provided on the neck of the bottle.

10. Device as claimed in claim 1, wherein the two parts constituting the neck adapter are produced from materials showing different mechanical and/or chemical properties.

11. The neck adapter as claimed in claim 1, wherein said flexible material is selected from the group consisting of polyethylene and butadiene.

12. The neck adapter as claimed in claim 1, wherein said relatively rigid plastic material is selected from the group consisting of polypropylene, low density polyethylene, polyamide, polyester, polycarbonate, ABS polymer and cellulose acetate.

* * * * *